United States Patent [19]

Shee

[11] 3,933,017

[45] Jan. 20, 1976

[54] KEY HOLDER AND RACK THEREFOR

[75] Inventor: William S. Shee, Woodbridge, Conn.

[73] Assignee: Signal Office Products Co., Milford, Conn.

[22] Filed: Feb. 5, 1975

[21] Appl. No.: 547,358

[52] U.S. Cl. ..... 70/456 R; 312/234.1

[51] Int. Cl.[2] ..... A47G 29/10

[58] Field of Search ..... 70/456 R, 458, 459; 150/40; 312/234.1, 234.2; 24/3 K, 201 A

[56] References Cited

UNITED STATES PATENTS

| | | | |
|---|---|---|---|
| 1,623,224 | 4/1927 | Yale | 70/456 R |
| 2,720,777 | 10/1955 | Kocsi | 70/456 R |
| 3,882,704 | 5/1975 | Shanok | 70/456 R |

*Primary Examiner*—Robert L. Wolfe

*Attorney, Agent, or Firm*—Ernest M. Junkins

[57] ABSTRACT

A key holder consisting of a flat sheet and a bifurcated fastener that holds one or more keys to the sheet by its bendable legs passing through a rectangular slot to thereby prevent rotation of the fastener while permitting relative rotation of the key. A rack holds a plurality of key carrying holders in at least one row with the holders being inclined to enable identifying indicia to be visible and to facilitate removal and replacement of the holder in the rack.

8 Claims, 9 Drawing Figures

KEY HOLDER AND RACK THEREFOR

The present invention relates to a key holder to which one or more keys are attached and a rack for storing a plurality of holders.

Generally, where a plurality of lock operating keys are stored together, some form of information pertaining to each key is necessary to enable a user to identify the key with the lock which it operates. In many instances this has taken the form of a tag that is secured to the key and on which the information is recorded. The tags are capable of being attached in many suggested ways, some of which require substantial dexterity thereby inhibiting attachment, disengagement and substitution of new keys on the holder. Moreover, the storage of tagged keys has generally heretofore been somewhat troublesome or inconvenient either being quite simple but yet normally hindering the selection of the desired key or if enabling ready identification being somewhat expensive and awkward.

It is accordingly an object of the present invention to provide a key holder which may be easily attached and detached to one or more keys and on which identifying indicia may be recorded.

Another object of the present invention is to provide a key holder which while achieving the above object enables a key to be readily positioned for either storage or use or any one key if a plurality of keys are attached to the holder while minimizing the possibility of harm to a user.

A further object of the present invention is to provide a rack for holding a plurality of key holders which stores the key holders in a manner which enables ready selection of a desired key, is compact and convenient to store and in which each key holder is easily and conveniently capable of being removed or replaced.

In carrying out the present invention, there is provided a key holder consisting of a rectangular sheet of substantially rigid material and a brass fastener of the type heretofore used to bind paper pages by being passed through a punched hole in the pages. Particularly, the fastener has a head and a pair of legs with the legs being bendable to form in effect a head on the reverse side. The sheet is formed to have a rectangular slot through which the fastener legs pass. Thus, with the legs passing through the slot and also an aperture in the key and being bent on the obverse side of the holder, the key is secured to the holder by the head and bent legs.

One or more keys may thus be secured to the same holder and yet each is capable of being pivoted to either a position wherein it is within the confines of the holder for storage or a position in which it extends outwardly from the holder for use. The slot is specifically dimensioned to prevent rotation of the fastener in the sheet to thereby obviate possible harm to the user by having an end of the bent leg project beyond the periphery of the sheet. The sheets have a rectangular periphery and rack means are provided to store the key holders in at least one row with the holders being somewhat inclined to thereby enable a portion of each holder to be readily visible. Accordingly, the rack means is formed by two sides with each having a plurality of parallel channels into each pair of which the side edges of each key holder are capable of being readily inserted and removed. In addition, opposite each pair of channels is a surface on which is preferably written an identifying indicia which corresponds to similar indicia written on the visible portion of each holder. Thus, by mating the rack indicia with the holder indicia and with each holder and channel pair having a unique indicia, a user may thus select and replace with ease and convenience a holder in its proper place in addition to readily ascertaining if any holders are either absent or not in their proper place in the rack.

Other features and advantages will hereinafter appear.

Referring to the drawing

Figure 1:
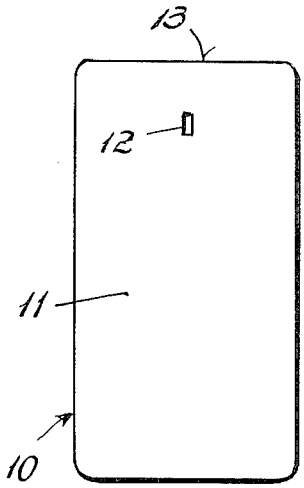
FIG. 1 is a plan of a flat sheet forming one part of the key holder of the present invention.

Referring to the drawing, the key holder of the present invention is generally indicated by the reference numeral 10 and includes a flat sheet 11 having a rectangular shape shown that is preferably formed from plastic material such as high impact sytrene to be rigid yet resistant to shattering or fracturing. A rectangular slot 12 is formed adjacent the top edge 13 thereof. The other part of the holder consists of a brass fastener 14 of the type normally utilized to bind paper pages together and which has a head 15 and a pair of parallel, bifurcated legs 16 and 17 formed of bendable sheet metal.

Figure 5:
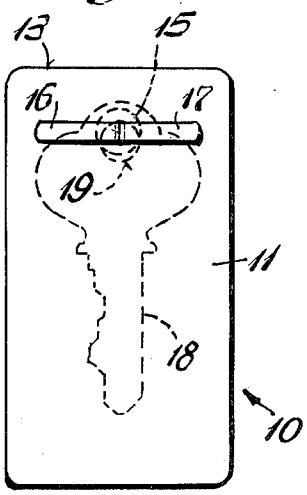
FIG. 5 is a plan of the obverse side of the holder.

The fastener 14 is utilized to hold and secure a key 18 to the sheet 11 by having the legs of the fastener pass through an aperture 19 formed in the key and through the slot 12 of the sheet 11 until the head 15 abuts the key. The portion of the legs projecting from the obverse side of the sheet are oppositel;y bent as shown in FIG. 5 to lie flush against the sheet.

Figure 3:
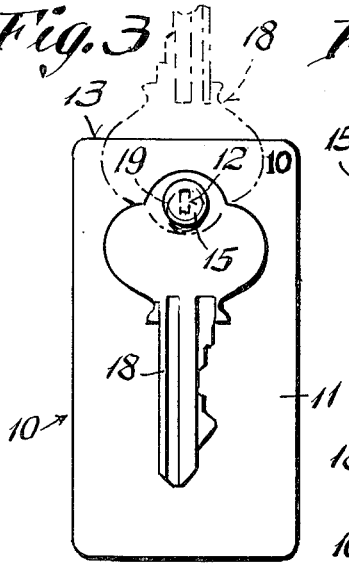
FIG. 3 is a plan showing a key attached to the holder.
Figure 4:
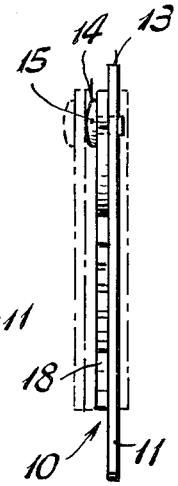
FIG. 4 is a side view thereof.

With the key secured in this manner, the key is capable of being positioned in a storage position where it is shown in solid lines in FIGS. 3 and 4 and wherein it lies flush with the sheet within the periphery thereof. However, it is capable of being pivoted with respect to the sheet to an operating position wherein it projects outwardly from the top edge 13 of the sheet as partially shown in dotted lines in FIG. 3 so that it may be used to operate its lock.

The fastener legs 16 and 17 are preferably of a length which enables a plurality of keys to be secured onto the sheet 11, the only effect being to somewhat decrease the extent of the legs that are capable of being bent after passing through the keys and slot. Thus, as shown in FIG. 4, in dotted lines, additional keys may be mounted by the fastener to the sheet with perhaps two or so keys on the front side of the sheet and perhaps one key on the obverse side of the sheet. Irrespective of the number of keys contained, however, it will be clear that each key is capable of being individually pivoted to project beyond the top edge for use and to assume its storage position wherein it lies within the confines of the periphery of the sheet 11.

Figure 6:
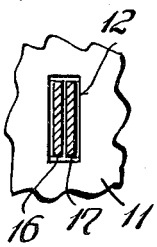
FIG. 6 is a detail, somewhat enlarged, showing the relationship between the fastener legs and the slot in the sheet.

As the slot 12 must be located near the top edge 13 in order to enable lock-operating usage of each key, and as it is desired to provide a fastener having long legs so that more than one key may be fastened to the sheet 11, the present invention minimizes the possibility of harm to a user which the ends of the bent over legs could cause if they extended beyond the sheet periphery, by preventing rotation of the fastener. Accordingly the rectangular slot 12, as shown in FIG. 6, is sufficiently wide so as to receive the portions of the two legs located therein but yet narrow enough to prevent rotation of the legs in the slot. Thus, the slot maintains the bent over legs of the fastener essentially in their position shown in FIG. 5 wherein the legs are bent transversely to the slot elongation which extends from the top edge 13 towards the center of the sheet.

Figure 7:
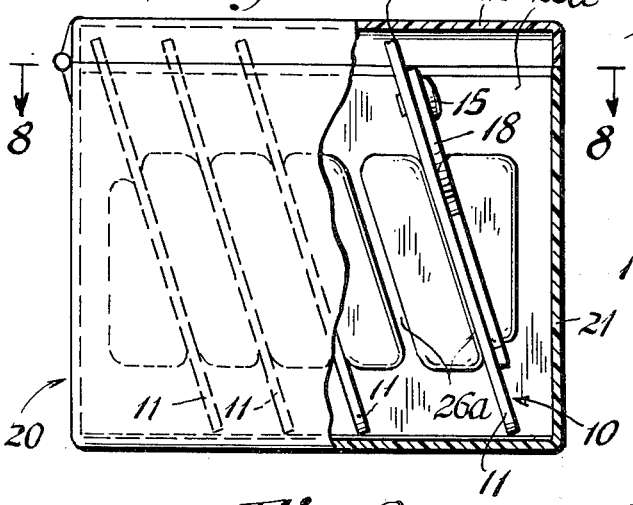
FIG. 7 is a side view, with a portion broken away, of a rack for holding a plurality of key holders.
Figure 2:
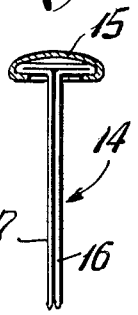
FIG. 2 is a plan partly in section, of a brass fastener that constitutes the other part of the holder.
Figure 9:
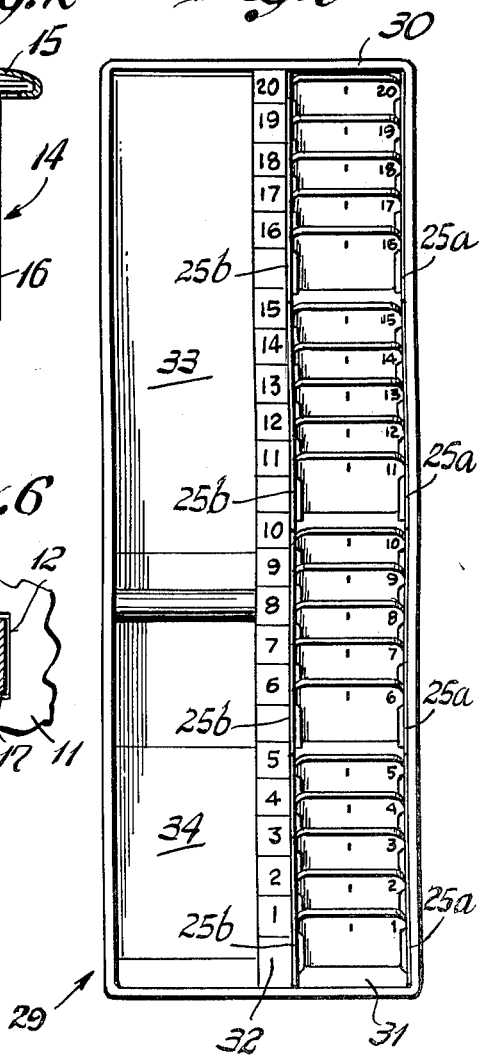
FIG. 9 is a top view of a further embodiment of a rack.
Figure 8:
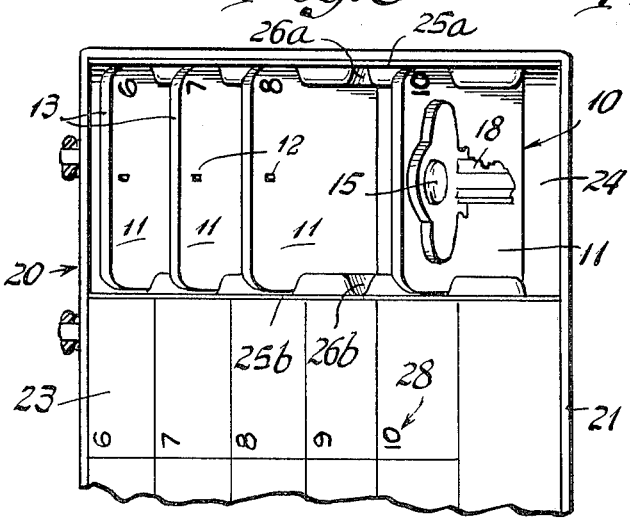
FIG. 8 is a section of a portion of the rack taken on the line 8—8 of FIG. 7.

Shown in FIGS. 7, 8 and 9 are two embodiments of rack means which are utilized to hold a plurality of key holders. One embodiment of the rack means is shown in FIG. 7 and 8 and indicated by the reference numeral 20. It includes a container 21, such as a file card box having a pivoted lid 22 with the lid 22, at least, being preferably formed of transparent material to permit visibility to the interior of the container when the top is down. As shown in FIG. 8, the container includes a partition that forms a top flat surface 23 and a recess 24 with the latter having side members 25*a* and 25*b*. The members 25*a* and 25*b* are symmetrical and preferably shaped from sheet plastic material so as to provide a plurality of inclined parallel channels such as the channel 26*a* formed in the side member 25*a* and a corresponding channel 26*b* formed in the side member 25*b*.

With a rack means 20 so constructed, each pair of channels is capable of receiving a key carrying key holder by merely sliding the side edges of the holder into the two channels. By reason of the configurations of the channels, the key holders are accordingly spaced apart and vertically inclined in a row so that the upper edge portion of each is visible. The present invention preferably provides an identifying indicia such as a number 10 on the sheet 11 as shown in FIG. 3 and a similar identifying number indicated by the reference numeral 28 on the surface 23. The surface 23 is preferably delineated to provide a writing space opposite each pair of channels to receive identifying indicia information which may be found desirable to the user of the keys, such as an indication of the whereabouts of the lock which the key attached to such an identified key holder operates.

The sheet 11 is preferably formed of material on which information pertaining to the key may be written. Also the writing is preferably easily erasable to thereby enable the information to be changed to correspond to the key which is currently attached to the holder. The identifying indicia may be permanently marked on the sheet if desired.

Shown in FIG. 9 is a rack which is capable of holding a larger number of key holders than the rack shown in the embodiment of FIGS. 7 and 8. Accordingly, the rack 29 includes a container 30 having a recess 31 formed between a side of the container and a partition having a top surface 32. The rack 29 as shown, includes a plurality of aligned side members 25*a* and 25*b*, four of each being shown and thus is capable of holding a row of twenty key holders. The surface 32 permits marking opposite each pair of channels, identifying indicia as shown. It will be understood that while a plurality of side members have been shown one unitary member may be employed for each side, if desired.

The rack 29 is further formed to have a pair of compartments 33 and 34 with the compartment 33 preferably being shaped to accommodate paper inserts which may be shaped similar to the shape of the sheet 11 for insertion into the channels to enable information of the key to be placed with the key holder but not be written on the holder. Extra fasteners may be contained within the compartment 34 if desired.

While the rack shown in FIG. 9 merely shows one row of key holders it is contemplated that another row together with another surface like the surface 32 may be formed on the other side of the compartments 33 and 34 or that a plurality of rows and surfaces may be formed adjacent each other. It is moreover noted that in FIG. 8 only a little more than half the key holder rack 20 is shown, the other half being essentially a mirror image of the portion shown.

With the present invention a user can glance at the rack and immediately determine if a key is missing by there being a void in a pair of channels. Moreover, the utilization of identifying indicia both on the rack and on a place on each key holder which is visible by reason of the parallel, inclined and spaced apart positioning of the holders, enables the user to easily select the key desired and also to enable the key to be easily replaced in the pair of channels from which it was removed.

It will accordingly be understood that there has been disclosed a key holder and rack means therefor which is composed of a single rectangular sheet of plastic material and a heretofore known fastener. The sheet is formed with a rectangular slot which enables the legs of the fastener to pass therethrough and to be bent on the obverse side of the sheet to secure one or more keys against the surface of the sheet. However, each key may be pivoted from a flush position within the confines of the sheet for storage or to a position where it projects therefrom for use. The utilization of a brass fastener having substantially long legs enables the holder to maintain a plurality of keys to the sheet but yet by dimensioning the slot with respect to the cross-sectional shape of the fastener legs, the fastener is prevented from rotating with respect to the sheet. Thus the ends of the legs are forced to lie within the confines of the sheet thereby obviating the possibility of harm caused by a projecting end to a user.

A plurality of holders are held in a row in parallel, spaced apart and vertically inclined relationship by a rack which enables visible identifying indicia to be placed on each key holder and also adjacent to each key holder a surface on which similar identifying indicia may be marked thereby enabling each key to be identified with its proper position for ease of selection and replacement.

Variations and modifications may be made within the scope of the claims and portions of the improvements may be used without others.

I claim:

1. A key holder to which a key having an aperture is securable comprising a flat sheet of essentially rigid material having a periphery at least as large as the key, an elongate rectangular slot formed in the sheet adjacent one edge thereof and a fastener having a head larger than the key aperture and essentially parallel bifurcated legs with said legs being rectangular in cross-section and formed of bendable material, said slot being dimensioned to permit passage of the parallel legs therethrough but to resist relative rotation of the fastener with respect to the flat sheet whereby the fastener legs are adapted to pass through the key aperture and the slot from one side of the sheet to the other side and be bent flat against the other side to secure the key to the sheet while permitting the key to be rotated with respect to the sheet.

2. The invention as defined in claim 1 in which the legs of the holder have a length such when bent flat the ends remain within the periphery of the sheet.

3. The invention as defined in claim 2 in which there are a plurality of keys, each having an aperture and in which the legs of the fastener are sufficiently long to pass through the plurality of apertures.

4. The invention as defined in claim 1 in which the slot is elongate in a direction from one edge of the sheet towards the center of the sheet and in which the legs are bent to extend in a direction perpendicular thereto.

5. The invention as defined in claim 1 in which there is a plurality of identical key holders and there are rack means for supporting the holders in a row with the holders being parallel, inclined and spaced from each other in the row whereby a corresponding portion of each is visible.

6. The invention as defined in claim 5 in which the rack means includes a pair of aligned, spaced apart side members, and in which each member has means defining a plurality of parallel, inclined and spaced apart channels whereby the side edges of each holder are adapted to be positioned in opposite channels on the side members.

7. The invention as defined in claim 5 in which each holder is adapted to be held by the rack to have a visible corresponding portion of each holder adjacent the one edge of the sheet in which identifying indicia is positioned on the corresponding portion of each holder, and in which the rack means includes means for forming an essentially flat surface adjacent the row of holders and of a length substantially coextensive therewith whereby identifying indicia may be marked on the surface adjacent each pair of channels.

8. The invention as defined in claim 7 in which the means forming the flat surface locates the surface adjacent the top edges of the row of holders and in which there are means defining at least one compartment on the other side of the flat surface forming means from the row of holders.

* * * * *